US006419031B1

(12) United States Patent
Pöysti

(10) Patent No.: US 6,419,031 B1
(45) Date of Patent: Jul. 16, 2002

(54) METHOD OF CONTROLLING ROCK DRILLING

(75) Inventor: Tapani Pöysti, Tampere (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 09/445,188

(22) PCT Filed: May 29, 1998

(86) PCT No.: PCT/FI98/00458

§ 371 (c)(1),
(2), (4) Date: Jan. 6, 2000

(87) PCT Pub. No.: WO98/57033

PCT Pub. Date: Dec. 17, 1998

(30) Foreign Application Priority Data

Jun. 13, 1997 (FI) ..... 972533

(51) Int. Cl.[7] ..... E21B 7/00
(52) U.S. Cl. ..... 175/24; 175/26
(58) Field of Search ..... 175/24, 61, 73, 175/26, 25, 38

(56) References Cited

U.S. PATENT DOCUMENTS

| | | | | |
|---|---|---|---|---|
| 3,385,376 A | | 5/1968 | Hobhouse | |
| 4,120,097 A | * | 10/1978 | Jeter | 33/307 |
| 4,271,914 A | | 6/1981 | Dressel | |
| 4,369,848 A | | 1/1983 | Salmi et al. | |
| 4,491,186 A | * | 1/1985 | Alder | 175/26 |
| 4,721,172 A | | 1/1988 | Brett et al. | |
| 4,936,397 A | * | 6/1990 | McDonald et al. | 175/26 |
| 5,435,402 A | * | 7/1995 | Ziegenfuss | 175/414 |
| 5,449,047 A | | 9/1995 | Schivley, Jr. | |
| 5,679,894 A | | 10/1997 | Kruger et al. | |
| 6,109,370 A | * | 8/2000 | Gray | 175/61 |
| 6,152,222 A | * | 11/2000 | Kyllingstad | 166/117.6 |

FOREIGN PATENT DOCUMENTS

| | | |
|---|---|---|
| DE | 43 02 755 | 8/1994 |
| EP | 0 112 810 | 7/1984 |
| FI | 81886 | 8/1990 |
| FI | 88744 | 3/1993 |
| GB | 2 183 272 | 6/1987 |
| GB | 2 196 668 | 5/1988 |
| WO | 97/08428 | 3/1997 |
| WO | 97/47858 | 12/1997 |

* cited by examiner

*Primary Examiner*—Frank Tsay
(74) *Attorney, Agent, or Firm*—Burns, Doane, Swecker & Mathis, L.L.P.

(57) ABSTRACT

A method of controlling rock drilling performed by a rock drill provided with a pressure-driven hammer and a rotation motor. In the method, the speed of rotation of the drill rod is defined on the basis of the value of the control signal used to control the control valve that adjusts the flow of the pressure fluid to the rotation motor.

12 Claims, 2 Drawing Sheets

METHOD OF CONTROLLING ROCK DRILLING

FIELD OF THE INVENTION

The invention relates to a method of controlling rock drilling performed by a rock drill provided with a pressure-driven hammer and a rotation motor, the rock drilling in the method being controlled by different control parameters, one of which is the speed of rotation of the drill rod.

BACKGROUND OF THE INVENTION

In rock drilling, the drilling is typically controlled by different parameters, the most general of which are the feed pressure, rotation pressure, and the impact pressure of the hammer. These values are typically transformed into electric signals, by which a computer can control the drilling in accordance with the desired limits or algorithms. In the drilling, the speed of rotation of the drill rod is also defined in different ways. In a manual solution, it is determined by rough estimation. The solution used in computer-controlled 'data equipment' is one in which the value of the control signal supplied to the electrically-driven valve is indicated as percentages of the maximum control range. It is also possible to use an electric sensor located at the rotation motor or in its transmission box, the sensor making it possible to measure the speed of rotation of the drill rod.

One of the drawbacks of these solutions is that the visual estimation of the speed of rotation is difficult and inaccurate. On the other hand, the speed of rotation expressed in percentages is difficult to understand. Further, a separate sensor measuring the speed of rotation in a rock drill is susceptible to damage and so it is not necessarily reliable.

Another problem here is that these values of the speed of rotation are in fact not utilized in any way in controlling the drilling. Therefore, the speed of rotation is set approximately to a value estimated to be suitable, and the actual drilling control is conducted by adjusting the other parameters.

SUMMARY OF THE INVENTION

The object of the present invention is to provide a method of controlling rock drilling, in which the speed of rotation of the drill rod is measured reliably and by which it can be used to control the actual rock drilling in a suitable manner. The method of the invention is characterized in that for the control, the speed of rotation of the drill rod is defined on the basis of the value of the control signal used to control the control valve that adjusts the flow of the pressure fluid supplied to the rotation motor, and that the value of the control signal indicating the speed of rotation is used as a control parameter.

The essential idea of the invention is that the control voltage or control pressure of the control valve of the rotation motor is measured, and that the voltage and pressure are converted to correspond to the speed of rotation by suitable scaling. Since the volume flow produced by the control voltage or pressure through the rotation motor can be expressed as a linear straight line, the converted control voltage and pressure correspondingly yield a linear speed of rotation. The essential idea of a preferred embodiment of the invention is that the parameter, such as the control pressure, expressing the speed of rotation is used in addition to the other parameters to control the rock drilling.

The advantage of the invention is that when the control pressure or voltage of the control valve of the rotation motor is used to indicate the speed of rotation, a reliable speed-of-rotation indicator, which is not easily damaged, is obtained. The speed of rotation can thus be controlled both manually and in other ways with the desired accuracy. Further, when in addition to the other control parameters the control element, or pressure signal or electric signal, of the control valve of the rotation motor is used to control the rock drilling, any changes in the conditions, for example in the fissure automation, can be taken into account, and the speed of rotation can be adjusted to be optimal in respect of the impact. Further, if the feed pressure control is based on the rotation pressure, i.e. moment adjustment is used, the parameter indicating the speed of rotation can be used to control the correct operational value.

BRIEF DESCRIPTION OF THE DRAWINGS

The invention will be described in greater detail in the attached drawings, in which.

DETAILED DESCRIPTION OF THE PREFERRED EMBODIMENT(S)

Figure 1:
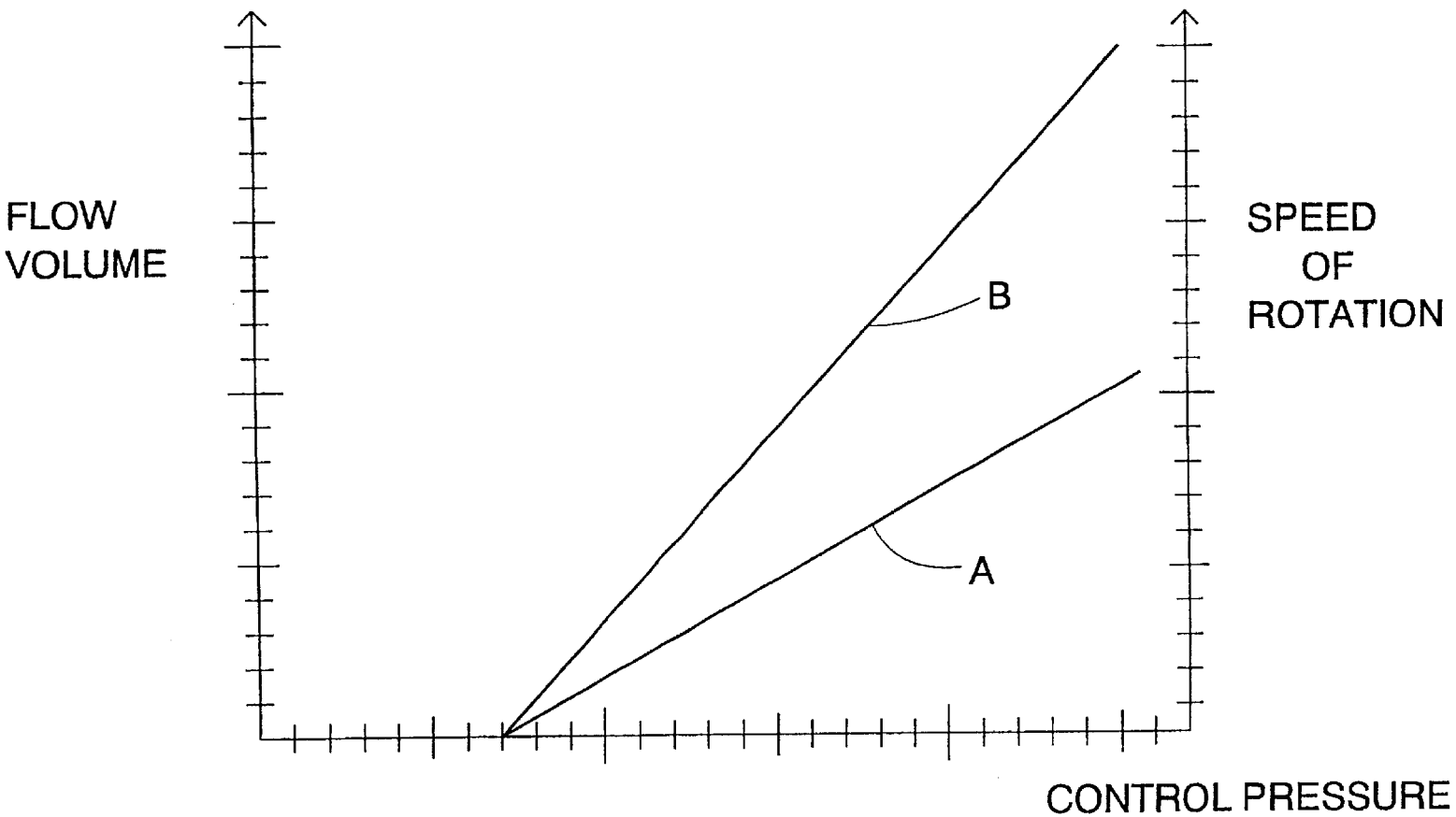
FIG. 1 is a schematic view showing the dependence between the volume flow linearized in accordance with the control pressure of the control valve in the rotation motor and the speed of rotation of the drill rod.

FIG. 1 is a schematic view showing the linear connection between the control pressure of the control valve in the rotation motor and the flow volume supplied to the rotation motor, i.e. the speed of rotation. In the figure, line A stands for the control pressure and line B for the speed of rotation of the rotation motor. The essential point is that there is an essentially linear connection between the volume flow and the speed of rotation, whereby the speed of rotation can be defined unambiguously by measuring the control pressure of the volume flow. Further, when electric control is used, there is a similar linear connection between the control voltage and the speed of rotation. The control voltage of the electrically-controlled valve can thus be used to unambiguously indicate the speed of rotation of the drill rod. A linear graph of the speed of rotation and the control voltage or the control pressure can be implemented technically by several linearization methods known per se.

Figure 2:
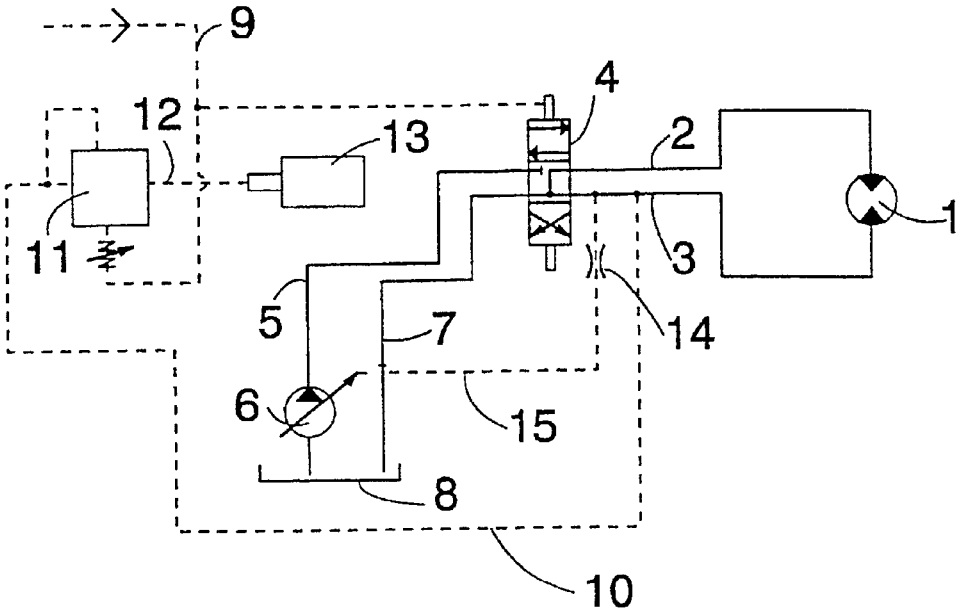
FIG. 2 is a schematic view of a hydraulic connection in which the control pressure value of the valve controlling the rotation is used to control the operation of so-called fissure automation.

FIG. 2 is a schematic view showing how the control pressure of the valve controlling the rotation can be used to control so-called fissure automation. The figure shows a rotation motor 1 connected by channels 2 and 3 to a proportional control valve 4. To the control valve 4 is connected a pressure fluid channel 5, to which a pump 6 supplies pressure fluid. The pressure fluid can flow along a channel 7 to a pressure fluid tank 8. The control valve 4 is here a pressure-controlled one, and it obtains the control pressure along a control pressure channel 9. From one of the pressure fluid channels 3 of the rotation motor 1, a control pressure channel 10 extends to a pressure limit valve 11, which is turn is connected by a channel 12 to a so-called fissure control valve 13. The control pressure channel 9 is further connected to the pressure limit valve 11 whereby it provides reference pressure and controls when the pressure limit valve 11 allows the control pressure supplied along channel 10 to control the fissure control valve 13. Further, from channel 3 of the rotation motor, a control channel is connected via a choke 14 to the pressure fluid pump 6, which is a so-called pressure-controlled volume flow pump.

When the control is in operation, a control pressure is supplied along the control channel 9 to valve 4, and the pressure makes the rotation motor 1 rotate in the normal direction of rotation. Control pressure is continuously obtained from the pressure fluid supply channel 3, leading to the rotation motor, through channel 15 to the pump 6, so that the volume flow passing through the rotation motor remains essentially constant. The pressure of the supply channel of the rotation motor simultaneously affects the pressure limit switch 11 through the control channel 10. As the control pressure of the valve 4 also controls the pressure difference value of the pressure limit valve 11, the increase of pressure in channel 3 caused by the rotation resistance will not affect the fissure valve 13 until the pressure difference between channel 3 and the control pressure channel 9 is equal to the pre-set value. The speed of rotation can thus be maintained at the pre-set value, while the control of the speed of rotation is used to give the rotation resistance a suitable threshold value before the supply is switched to a return motion by the fissure valve 13. When the pressure from channel 3, i.e. the supply channel, of the feed motor exceeds the pressure of the control valve 4 and the control channel 9 by the threshold value set for the pressure limit valve 11, the pressure of channel 3 is supplied through the pressure limit valve 11 to the fissure control valve 13, which is turn switches the feed motor of the rock drill (not shown) to a return motion in a manner known per se, until the pressure again drops below the threshold value set for valve 11.

The invention can also be applied so that the speed of rotation is utilized when the impact frequency of the rock drill changes with the impact pressure. The value of the speed of rotation can thus be controlled in accordance with the impact frequency, i.e. here impact pressure, so that the rotation of the drill bit between the impacts is of a desired order, and that the outermost buttons of the drill bit settle in a suitable position between the button positions of the previous impact. This enhances the rock-breaking effect of the impact.

The invention is described in the above specification and in the drawings only by way of an example, and it is not to be understood as being limited thereto. The essential feature is that the speed of rotation is measured or defined on the basis of the control element, such as the voltage or the pressure, of the control valve of the rotation circuit, and that the resultant value of the speed of rotation is then used, if necessary, with the other parameters to control the rock drilling.

What is claimed is:

1. A method for controlling rock drilling performed by a rock drill provided with a pressure-driven hammer and a rotation motor, the rock drilling in the method being controlled by different control parameters, one of which is a speed of rotation of a drill rod, the speed of rotation of the drill rod is defined on the basis of a value of a control signal used to control a control valve that adjusts a flow of pressurized fluid supplied to the rotation motor, and the value of the control signal indicates the speed of rotation of the drill rod.

2. A method according to claim 1, wherein the control valve used is an electrically-controlled valve, and that the control parameter used is a value of an electric control signal of said control valve.

3. A method according to claim 1, wherein the control valve used is a valve controlled by a pressure of the pressurized fluid, and the control parameter used is a value of a pressure signal, or control pressure, of said control valve.

4. A method according to claim 1, wherein a control means for switching feed of the rock drill to a return motion as rotation resistance of the drill rod exceeds a pre-set threshold value, the control signal indicating the speed of the rotation is arranged to set a reference value for the control means, and that the control means for switching the flow of pressurized fluid to a return motion only after the rotation resistance of the drill rod exceeds said reference value by a predetermined amount.

5. A method according to claim 4, wherein the reference value used is the control pressure of the control valve of the rotation motor, and a value indicating the rotation resistance is a pressure of the pressurized fluid in a supply channel to the rotation motor, and a controllable pressure limit valve is arranged between a control pressure channel of the control valve of the rotation motor and the supply channel of the rotation motor so that when the pressure in the supply channel to the rotation motor exceeds a pressure in the control pressure channel by a set pressure of the pressure limit valve, the pressure in the supply channel of the rotation motor switches the feed motor of the rock drill to a return motion.

6. A method of rock drilling using a rock drill with a drill rod, a rotation motor and a control valve, comprising:

measuring a value of a control signal for the control valve that adjusts a pressure fluid flow to the rotation motor; and determining a speed of rotation of the drill rod using the value as a control parameter.

7. The method according to claim 6, wherein the control valve is an electrically-controlled valve.

8. The method according to claim 6, wherein the control signal being measured is an electrical control signal of the control valve.

9. The method according to claim 6, wherein the control valve being used is a valve which is controlled by pressure exerted by the pressure fluid.

10. The method according to claim 6, wherein the control signal being measured is a pressure signal of the valve.

11. The method according to claim 6, further includes providing control means wherein the value indicating the speed of the rotation is arranged to a set reference value, and that the control means moves the drill rod to a return motion after a rotation resistance of the drill rod exceeds the reference value by a predetermined value.

12. The method according to claim 11, wherein the reference value used is the control pressure of the control valve of the motor, and the rotation resistance is the pressure of the pressure fluid in a supply channel of the motor, and that a controllable pressure limit valve is arranged between the control pressure channel of the control valve of the motor and the supply channel so that when the pressure in the supply channel exceeds the pressure in the control pressure channel by a set pressure of the pressure limit valve, the pressure in the supply channel of the motor switches a feed motor of the rock drill to the return motion.

* * * * *